US006479919B1

(12) United States Patent
Aselage et al.

(10) Patent No.: US 6,479,919 B1
(45) Date of Patent: Nov. 12, 2002

(54) BETA CELL DEVICE USING ICOSAHEDRAL BORIDE COMPOUNDS

(76) Inventors: Terrence L. Aselage, 62 Avenida Del Sol, Cedar Crest, NM (US) 87008; David Emin, 1502 Harvard Ct., NE., Albuquerque, NM (US) 87106-3712

( * ) Notice: Subject to any disclaimer, the term of this patent is extended or adjusted under 35 U.S.C. 154(b) by 0 days.

(21) Appl. No.: 09/832,278

(22) Filed: Apr. 9, 2001

(51) Int. Cl.[7] ..... G21H 1/06; G21H 1/00
(52) U.S. Cl. ..... 310/303; 310/301
(58) Field of Search ..... 310/300, 301, 310/303, 304, 305; 376/320; 429/5

(56) References Cited

U.S. PATENT DOCUMENTS

| | | | | |
|---|---|---|---|---|
| 3,706,893 A | * | 12/1972 | Olsen et al. | 136/253 |
| 4,591,654 A | | 5/1986 | Yamaguchi et al. | 136/252 |
| 5,260,621 A | | 11/1993 | Little et al. | 310/303 |

OTHER PUBLICATIONS

Wood, Charles et al. "Conduction mechanism in boron carbide" Physical Review B, Apr. 15, 1984, V.29, No. 8, pp. 4582–4587.*

Wood, Charles et al. "Thermal conductivity of boron carbides" Physical Review B, May 15, 1985, V.31, No. 10, pp. 6811–6817.*

Howard, I.A., et al., "Bipolarons in boron–rich icosahedra: Effects of carbon substitution" Physical Review B, Jun. 15, 1987, V.35, No. 17, pp. 9265–9270.*

Howard, I.A., et al. "Bipolarons in boron icosahedra" Physical Review B, Feb. 15, 1987, V.35, No. 6, pp. 2929–2933.*

Chauvet, O., et al., "Spin susceptibility of boron carbides" Physical Review B, Jun. 1, 1996, vol. 53, No. 21, pp. 14450–14457.*

Rappaport, P., Loferski, J. and Linder, E., "The Electron–Voltaic Effect in Germanium and Silicon p–n Junctions," RCA Reviews, 1956, 17, 100–128.

Kosteski, T., Kherani, N., Gaspari, F., Zukotynski, S., and Shmayda, W., "Tritiated Amorphous Silicon Films and Devices," J. of Vacuum Sci. and Tech. Part A, 1998, 16, 893–896.

Olsen, L., "Advanced Betavoltaic Power Sources," Proc. Of the 9$^{th}$ Intersociety Energy Conv. Eng. Conf., Amer. Nuclear Soc., 1974, 754–762.

Carrard, M., Emin, D., and Zuppiroli, L., "Defect Clustering and Self–Healing of Electron–Irradiated Boron–Rich Solids," Phys. Rev. B, 1995, 51(17), 270–274.

* cited by examiner

*Primary Examiner*—Burton S. Mullins
(74) *Attorney, Agent, or Firm*—Bingham McCutchen LLP; David G. Beck

(57) ABSTRACT

A beta cell for converting beta-particle energies into electrical energy having a semiconductor junction that incorporates an icosahedral boride compound selected from $B_{12}As_2$, $B_{12}P_2$, elemental boron having an α-rhombohedral structure, elemental boron having a β-rhombohedral structure, and boron carbides of the chemical formula $B_{12-x}C_{3-x}$, where $0.15<x<1.7$, a beta radiation source, and means for transmitting electrical energy to an outside load. The icosahedral boride compound self-heals, resisting degradation from radiation damage.

18 Claims, 5 Drawing Sheets

BETA CELL DEVICE USING ICOSAHEDRAL BORIDE COMPOUNDS

This invention was made with Government support under Contract No. DE-AC04-94AL85000 awarded by the United States Department of Energy. The Government has certain rights in the invention.

BACKGROUND OF THE INVENTION

A device for direct solid-state conversion of nuclear energy to electrical energy, and, more particularly, a beta-cell that uses icosahedral boride compounds for the direct solid-state conversion of beta-particle energy to electrical energy.

Nuclear energy of some radioisotopes is primarily released in the form of beta particles. Beta particles are very energetic electrons that are emitted from a nucleus as a product of its decay. Prominent beta-emitting radioisotopes include $^{90}$Sr, $^{147}$Pm, and $^{170}$Tm. The beta particles emitted by these isotopes have maximum energies between 0.2 and 2.3 MeV. Beta cells utilize beta, particles from radioisotope decays with a material, such as a semiconductor material, to produce electrical power.

Upon passing through a semiconductor, a beta particle excites electrons thereby creating many electron-hole pairs. Each beta particle generates approximately $10^3$ to $10^5$ electron-hole pairs. The local electric field of a semiconductor junction tends to separate the paired electrons and holes thereby creating a current. This charge separation is especially efficient (near 100%) in materials in which the created electrons and holes each move with a high mobility (for example, greater than 10 $cm^2$/V-sec at 300 K). Incident beta particles can thereby generate currents in a semiconductor junction. This current generation scheme is analogous to that by which incident photons create a current in a solar cell.

Devices that convert beta radiation directly to electricity are termed beta cells. Unlike solar cells, beta cell energy sources are self-contained and reliable. Unlike chemical power sources such as batteries, beta cells are not rapidly exhausted. Indeed, beta-cell development is motivated by the huge energy capacities of prominent beta sources ($10^7$ to $10^8$ W-hr/kg of fuel) compared with those of even excellent chemical sources (e.g., $10^4$ W-hr/kg of gasoline).

Beta cells can be designed to produce high power, to have a long half-life, or to require little shielding by choosing among different radioisotope energy sources. The size and mass of a beta cell will be determined primarily by the thickness of any shielding required to attenuate the Brehmsstrahlung and any gamma rays that accompany beta emission to desired levels. For example, the continuous power of emitted beta particles from 0.8 kg of the isotope $^{170}$Tm is about 10 kW. The half-life of $^{170}$Tm is about four months. Assuming 10% conversion efficiency, a beta cell fueled by this $^{170}$Tm source would deliver about 1 kW of electrical power for about four months. Shielding the Brehmsstrahlung and gamma rays from 0.8 kg of $^{170}$Tm to safe levels would require about 9 cm of lead. As a second example, the continuous power of emitted beta particles from 0.01 gm of $^{90}$Sr is about 10 mW over a half-life of 28 years. This small amount of $^{90}$Sr would require no shielding. Assuming 10% conversion efficiency, a beta cell fueled by this $^{90}$Sr source would continuously deliver about 1 mW of electrical power for tens of years.

Beta cells can find many applications wherever high-energy-capacity, reliable power sources are needed. For example, low-power beta cells could power remote sensors, microsystems, and small electronic appliances such as laptop computers and pacemakers. High-power beta cells could provide power for remote installations, spacecraft, and military units, among others.

Although beta cells have many potential uses, beta cells constructed with conventional semiconductors such as Si, Ge, GaAs, or CdTe have very limited utility because they suffer collateral radiation damage. In particular, incident high-energy beta particles create defects within the semiconductor that scatter and trap the generated charge carriers. This radiation damage accumulates, thereby degrading the performance of the semiconductor as an energy-conversion device. For example, silicon beta cells fueled by $^{90}$Sr were studied in the early 1950's (see e.g., P. Rappaport, J. Loferski, and E. Linder, RCA Reviews, 1956, 17, 100–128). The electrical output of these cells degraded rapidly, over a few days, as a result of accumulating damage.

The output of conventional solar cells is degraded even by exposure to the very low flux of high-energy electrons encountered by orbiting satellites in space environments. The degree of degradation has been found to depend on the conventional semiconductor used in the solar cell (see e.g. Yamaguchi et al., U.S. Pat. No. 4,591,654, issued on May 27, 1986). The fluxes of energetic beta particles emitted by useful radioisotopes exceed the flux of energetic electrons in space by many orders of magnitude.

Thus, beta cells made of standard semiconductors such as Si can be used only for very short times or with very weak beta sources, such as $^3$H or $^{147}$Pm. Beta cells fueled by these very weak sources have been studied intermittently since the 1970's (see e.g., T. Kosteski, N. Kherani, F. Gaspari, S. Zukotynski and W. Shmayda, J. of Vacuum Sci. and Tech. Part A, 1998, 16, 893–896; and L. Olsen, Proc. Of the $9^{th}$ Intersociety Energy Conv. Eng. Conf., Amer. Nuclear Soc., 1974, 754–762).

Thermally insulated beta cells that would utilize heat from radioisotope decays to operate at high temperatures have been described (see Little et al., U.S. Pat. No. 5,260,621, issued on Nov. 9, 1993). It was proposed that high-temperature annealing of defects would limit the radiation-induced degradation of beta-cell performance.

Needed is a beta cell that can efficiently produce electricity at normal operating temperatures that have little or no radiation-induced degradation in performance.

DETAILED DESCRIPTION OF THE INVENTION

In the present invention, a beta cell is provided comprising a semiconductor junction device made of an icosahedral boride semiconductor, a radioisotope source of beta radiation, and means for transmitting electrical energy to an outside load. Because of the use of the icosahedral boride semiconductor, the beta cell of the present invention does not suffer the long-term conventional radiation-induced damage to a degree to significantly degrade the performance of the beta cell. Carrard et al. (M. Carrard, D. Emin; and L. Zuppiroli, Physical Review B, 1995, 51, 270–274) demonstrated that some boron compounds do not suffer accumulating damage from high-energy electron bombardment even at temperatures as low as 91K. These solids are called icosahedral borides. Icosahedral borides are solids primarily composed of boron atoms that form clusters whose atoms reside at the twelve vertices of icosahedra. Carrard et al. thus find that beta-induced damage to icosahedral borides spontaneously self-heals.

The present invention relates to the use of icosahedral boride semiconductors in beta cells. In particular, the self-healing of beta-induced damage in icosahedral boride semiconductors permits beta cells based on icosahedral boride semiconductors to utilize sources that emit high-energy beta particles such as $^{90}Sr$ or $^{170}Tm$. Because of self-healing, the lifetimes of icosahedral boride beta cells are limited by the rate of decay of the radioisotope energy source rather than by radiation damage to the semiconductor. Examples of icosahedral boride semiconductors include $B_{12}As_2$, $B_{12}P_2$, elemental boron in both its α-rhombohedral and β-rhombohedral structures, and boron carbides, $B_{12-x}C_{3-x}$, where $0.15<x<1.7$ (the single phase region of $B_{12-x}C_{3-x}$). Room-temperature carrier mobilities in several icosahedral boride semiconductors, $B_{12}As_2$, $B_{12}P_2$, and α-rhombohedral boron, are comparable to those of semiconductors that are commonly utilized in solar cells. These mobilities are high enough for these icosahedral borides to operate efficiently in beta cells. Sources of beta radiation include the radioisotopes $^{90}Sr$, $^{147}Pm$, $^{170}Tm$, $^{3}H$, $^{63}Ni$, $^{137}Cs$, $^{141}Ce$, and $^{204}Tl$, and compounds containing these radioisotopes.

Figure 1:
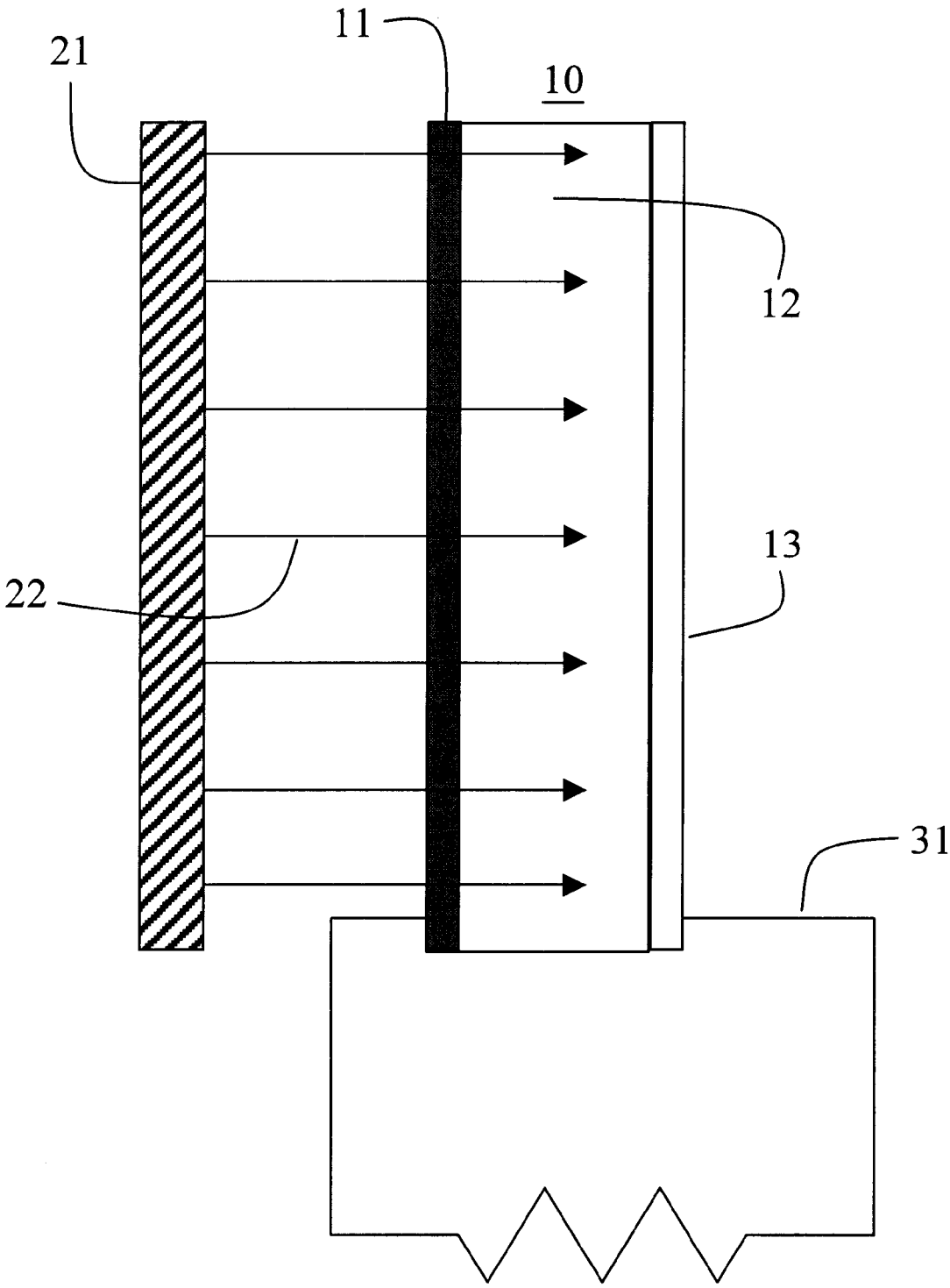
FIG. 1 is an illustration of an icosahedral boride Schottky barrier device in surface contact with a layer of a beta-emitting radioisotope.

One embodiment of the present invention, shown in FIG. 1, comprises a Schottky-barrier junction device 10, a beta-emitting radioisotope stratum 21 that emits beta radiation 22, and means 31 for transmitting the produced,electrical energy to a load. The Schottky-barrier device can be formed by depositing a thin metal contact 11 that serves as a Schottky barrier (a non-Ohmic contact), for example Au, on an icosahedral boride semiconductor 12. The thickness of the metal contact, typically 0.1 to 0.5 microns, is kept small to minimize loss of beta-particles' energy 22 as it passes through the metal. The icosahedral boride semiconductor may be a film of typical thickness 0.1 to 100 microns deposited on a substrate such as SiC or a metal diboride (such as $NbB_2$, $TiB_2$, $ZrB_2$, $HfB_2$, $TaB_2$) or a free-standing icosahedral boride semiconductor. Another, Ohmic, metal contact 13 on the unirradiated back side of the sandwich completes the electrical circuit. The layer of the beta-emitting radioisotope, for example $^{90}Sr$ or compounds containing $^{90}Sr$ such as $^{90}SrTiO_3$, is typically of thickness 0.1 to 50 microns. The maximum thickness of the beta-emitting radioisotope stratum will be fixed for each radioisotope by the self-absorption depth of the radioisotope, beyond which no beta particles can escape the stratum.

Figure 2:
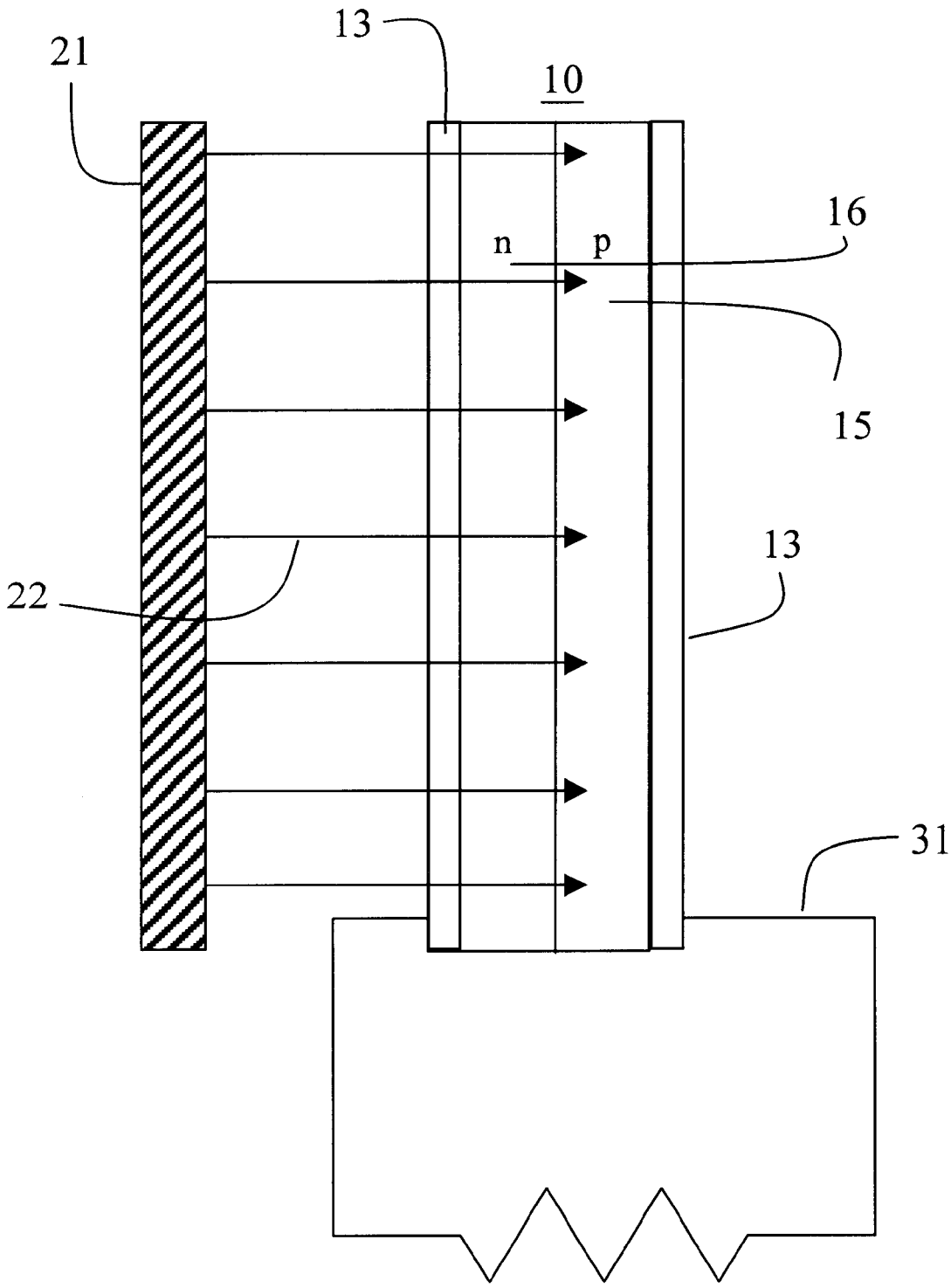
FIG. 2 is an illustration of an icosahedral boride p-n junction device in surface contact with a layer of a beta-emitting radioisotope.

Another embodiment of the invention, a variation of the beta cell illustrated in FIG. 1, comprises a p-n junction icosahedral boride semiconductor device and a beta-emitting radioisotope stratum (see FIG. 2). Boron carbides and β-rhombohedral boron are intrinsically p-type and native defects in both $B_{12}As_2$ or $B_{12}P_2$ frequently render them p-type. The p-type region 15 can also be established by incorporating a p-dopant, for example substituting Si, Ge, or C, for As or P in $B_{12}As_2$ or $B_{12}P_2$. The n-type region 16 is established by incorporating an n-dopant, for example S, Se, or Te for P or As in $B_{12}As_2$ or $B_{12}P_2$. The thickness of the n- and p-type regions are typically between 0.1 and 100 microns. The beta-emitting radioisotope is selected from for example $^{90}Sr$, $^{147}Pm$, and $^{170}Tm$. As with the prior embodiment, the optimal thickness of the radioisotope stratum is determined by its self-absorption length. Electrical leads from the p-type region and the n-type region connect the p-n junction device with the rest of the electrical system.

Figure 3:
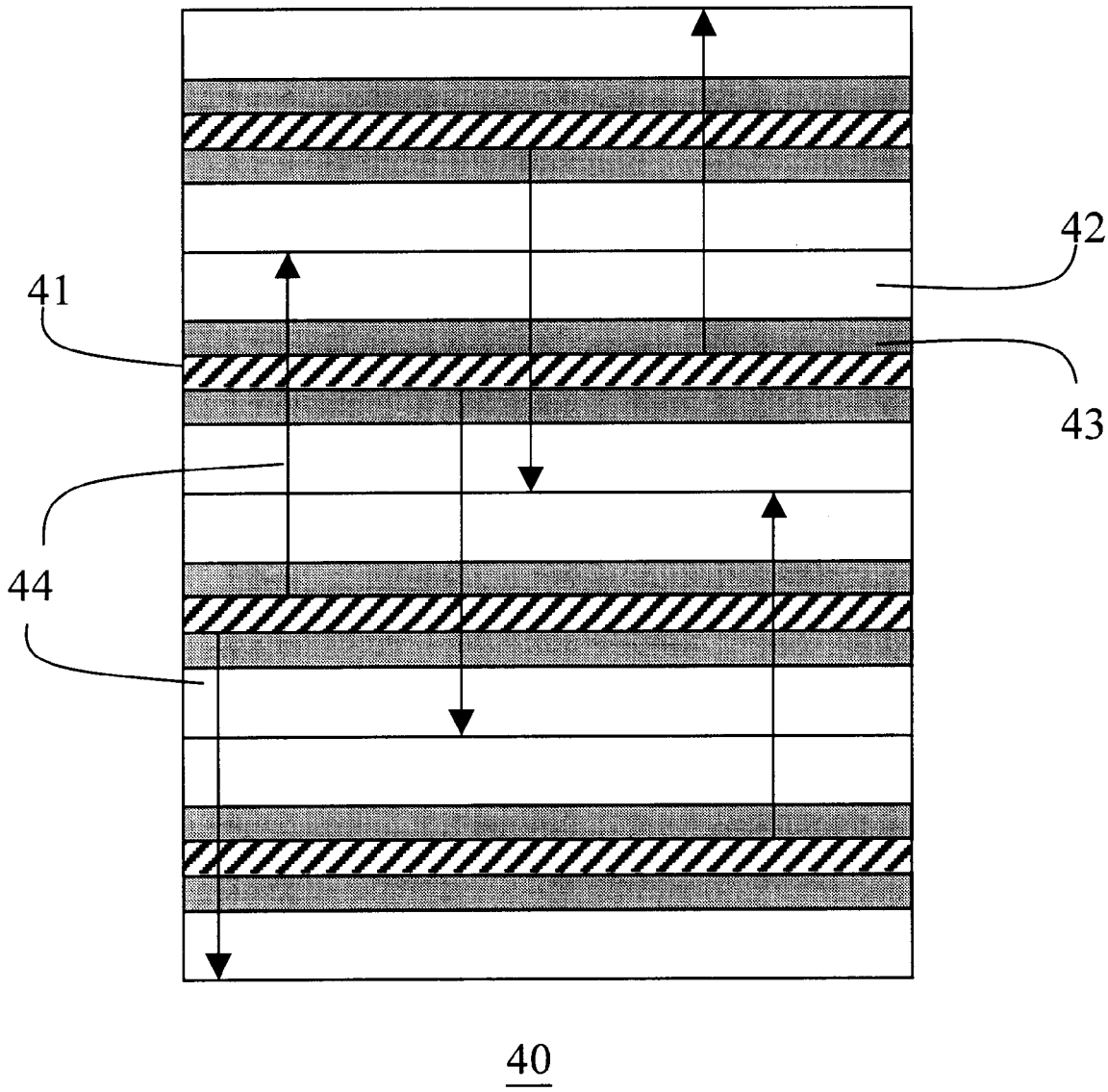
FIG. 3 illustrates a three-dimensional array of alternating layers of icosahedral boride junction devices and beta-emitting radioisotope layers.

Another embodiment of the invention, illustrated in FIG. 3, comprises a 3-dimensional stack 40 incorporating alternate strata (generally approximately uniform layers) of beta-emitting radioisotope 41 and icosahedral boride junction devices that can comprise both p-type regions 42 and n-type regions 43. As illustrated in FIG. 3, a 3-dimensional stack utilizes beta particles 44 emitted from both faces of radioisotope strata. Furthermore, beta particles emitted from radioisotope layers can have ranges that allow them to traverse several semiconductor junction devices in the stack. The 3-dimensional stack thus permits more efficient collection of beta-particles energies. Individual junction devices within this stack can be either Schottky-barrier or p-n junction devices as described in the prior embodiments. The means for transmitting the produced electrical energy are not shown in FIG. 3.

Figure 4:
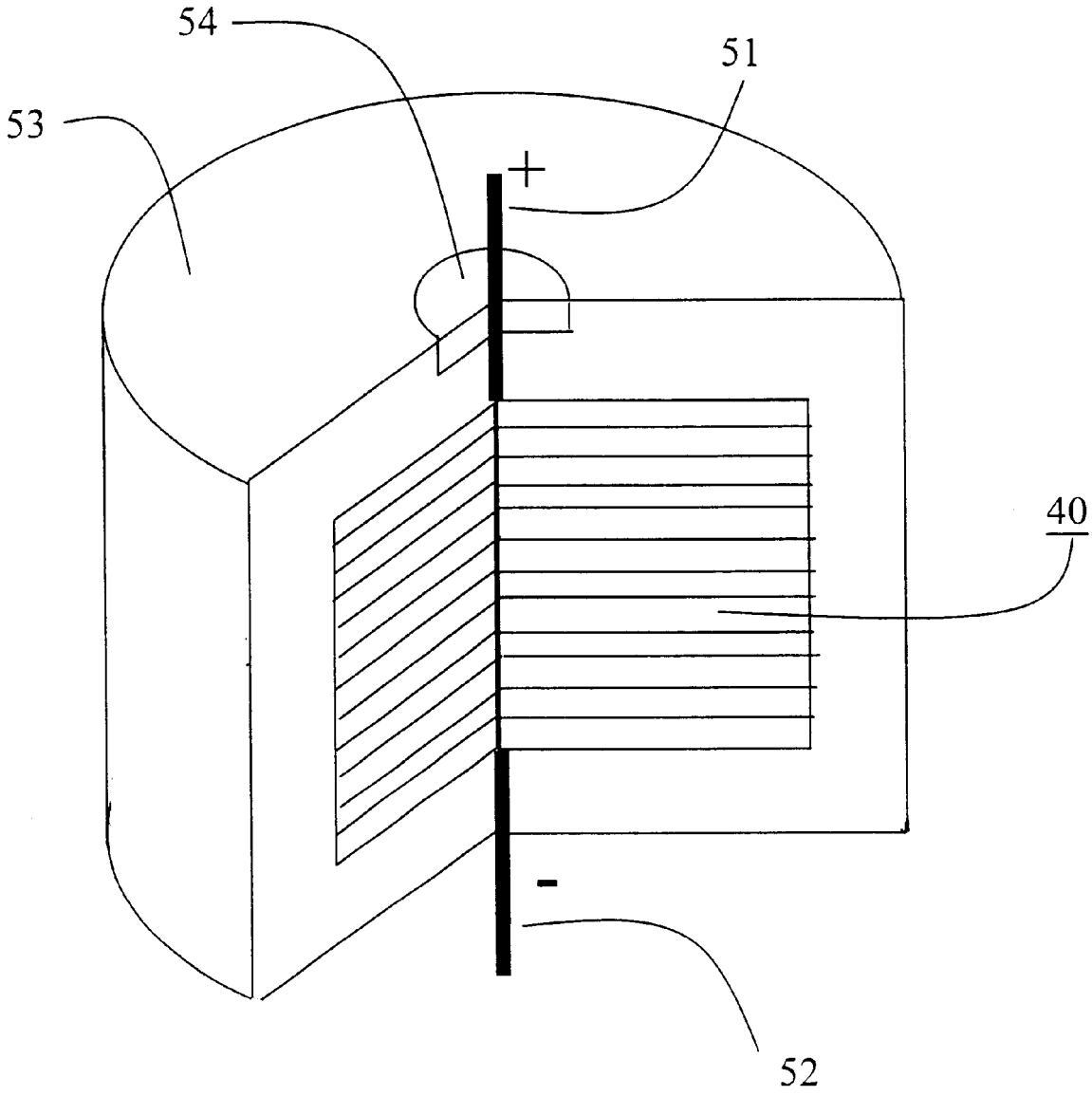
FIG. 4 is a cut-away view of a three-dimensional array of icosahedral boride junction devices enclosed within a shielding metal case, with positive electrical lead through an insulating seal in the case and negative electrical lead to the case.

The beta cell is generally enclosed within a metal shield (case), as illustrated in FIG. 4. The thickness and type of material of the shield. 53 is such that radiation produced by the beta cell is attenuated to desired levels outside the case. The electrical output of the stack (such as the stack 40 illustrated in FIG. 3) is established across a positive terminal 51 and a negative terminal 52. In general, at least one terminal projects through an opening in an electrically insulating cap 54 in the shield. The shield material and its thickness is selected based on the beta source and the application. For example, for when minimal or no shielding is required, an aluminum case could be appropriate. For other embodiments that require shielding, the shield could be made from such metals as lead or depleted uranium.

The beta cell of the present invention can be utilized in a variety of configurations, including both series and parallel combinations to achieve the desired output currents and voltages. Additionally, the type of beta source and the configuration of the beta source with respect to the type of icosahedral boride material and layer thickness and number of layers of icosahedral bride material can be varied to achieve the desired electrical energy output.

Figure 5:
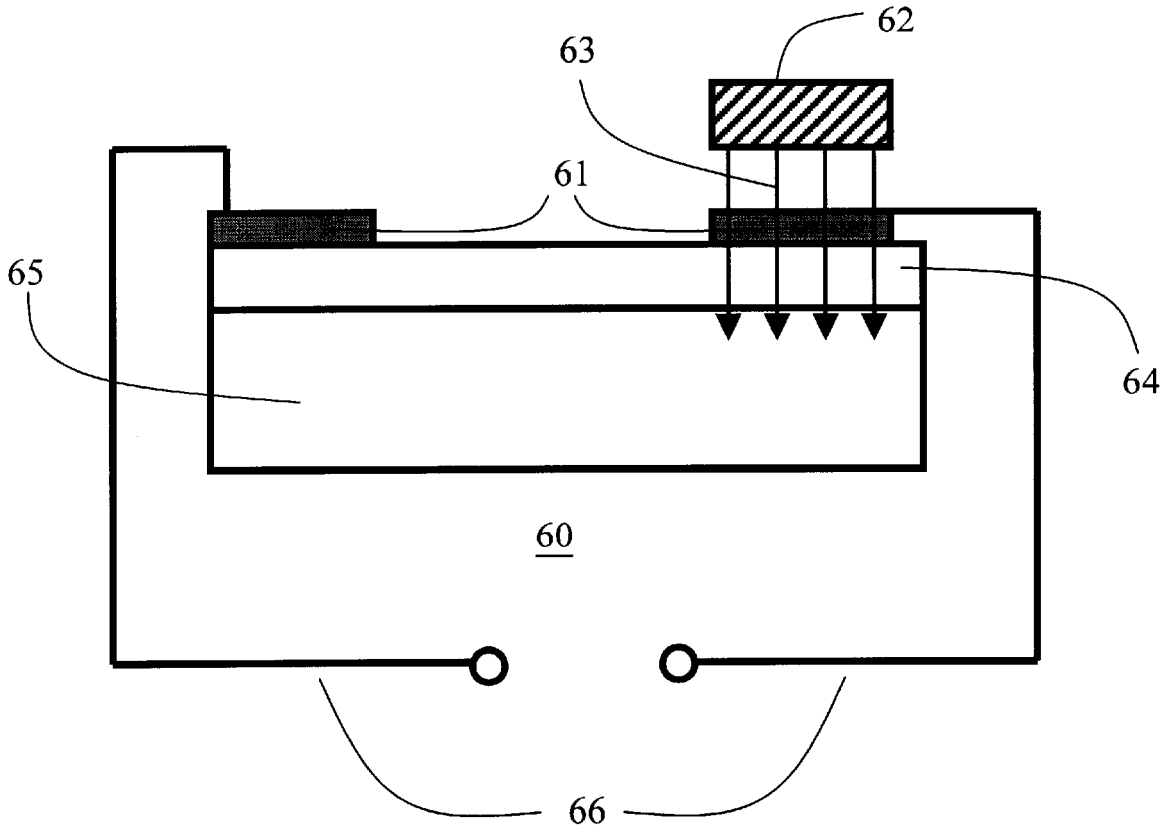
FIG. 5. illustrates a configuration of an icosahedral boride Schottky-barrier device used in the example.

One embodiment of the present invention is specifically illustrated by a configuration of the cell of FIG. 5. A Schottky-barrier device 60 was created by depositing separate gold contacts 61 onto the surface of a film of semiconducting $B_{12}As_2$ 64, which was layered on top of a SiC substrate 65. Electrical leads 66 were attached to the Au contacts to transmit the produced electrical energy to a load. In this example, the $B_{12}As_2$ was a p-type semiconductor. In this example, the thickness of the $B_{12}As_2$ film was approximately 0.1 micron. A beam of energetic electrons 63, from a source 62, was caused to impinge upon one of the Au contacts. The thickness of this Au contact was approximately 0.1 micron. When the energy of the impinging electrons was insufficient to penetrate this thickness of Au, less than about 10 keV, no emf was measured across the bombarded junction. When the energy of the incident electron beam was sufficient to penetrate through the Au contact, an emf was produced. This emf was caused by the separation of the electron-beam induced electron-hole pairs in the $B_{12}As_2$ semiconductor. The open-circuit emf of the Schottky-barrier device was measured relative to the non-bombarded junction. A 40 keV beam generated an open circuit emf of 800 mV.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A beta cell for converting beta-particle energies into electrical energy, comprising:

a semiconductor junction incorporating an icosahedral boride compound, wherein the icosahedral boride compound is selected from the group consisting of $B_{12}As_2$, $B_{12}P_2$, elemental boron having an α-rhombohedral structure, elemental boron having a β-rhombohedral structure, and boron carbides of the chemical formula $B_{12-x}C_{3-x}$, where $0.15<x<1.7$;

a beta radiation source; and means for transmitting electrical energy to an outside load.

2. The beta cell of claim 1, further comprising a shield encapsulating said semiconductor junction and said beta source.

3. The beta cell of claim 1, wherein self-healing of beta-induced damage to the icosahedral boride compound is effective at ambient operating temperatures.

4. The beta cell of claim 1, wherein the beta radiation source is selected from compounds that contain $^{90}Sr$, $^{147}Pm$, $^{170}Tm$, $^{3}H$, $^{63}Ni$, $^{137}Cs$, $^{141}Ce$, and $^{204}Tl$.

5. The beta cell of claim 1, wherein said junction is a Schottky barrier comprising a metal contact deposited on an icosahedral boride semiconductor.

6. The beta cell of claim 1, wherein the semiconductor junction occurs in a free-standing icosahedral boride material.

7. The beta cell of claim 1, wherein said semiconductor junction comprises a p-n junction, said p-n junction comprising juxtaposed layers of an n-type region and a p-type region.

8. The beta cell of claim 7, wherein said n-type region comprises the icosahedral boride compound and incorporates an n-dopant selected from the group consisting of S, Se and Te.

9. The beta cell of claim 7, wherein said p-type region comprises the icosahedral boride compound.

10. The beta cell of claim 7, wherein said p-type region comprises the icosahedral boride compound and incorporates a p-dopant selected from the group consisting of Si, Ge and C.

11. The beta cell of claim 7 wherein said layers have thickness from approximately 0.1 micron to approximately 1000 micron.

12. A beta cell for converting beta-particle energies into electrical energy, comprising:

a semiconductor junction incorporating an icosahedral boride compound, wherein the semiconductor junction is deposited on a substrate selected from the group of substrates consisting of SiC and metal diboride compounds;

a beta radiation source;

means for transmitting electrical energy to an outside load; and an electrical contact of a metal diboride compound layered between the substrate and the icosahedral boride compound.

13. A beta cell device for converting beta-particle energies into electrical energy, comprising:

a stack of beta cells comprising beta radiation-emitting strata and semiconductor junction strata, said semiconductor junction strata incorporating an icosahedral boride compound, wherein the icosahedral boride compound is selected from the group consisting of $B_{12}As_2$, $B_{12}P_2$, elemental boron having an α-rhombohedral structure, elemental boron having a β-rhombohedral structure, and boron carbides of the chemical formula $B_{12-x}C_{3-x}$, where $0.15<x<1.7$;

a means of forming electrical connections between individual beta cells in the stack;

a shield encapsulating said beta radiation-emitting strata, said semiconductor junction strata, and said electrical connections;

a positive conductor terminal and a negative conductor terminal being accessible externally of said shield; and said positive conductor terminal and said negative conductor terminal operatively connected to means for transmitting electrical energy to an outside load.

14. The beta-cell device of claim 13, with one externally accessible conductor terminal being operatively connected to the positive-polarity electrical connections between parallel individuals cells, and at least one externally accessible conductor terminal being operatively connected to the negative-polarity electrical connections between parallel individual cells.

15. The beta-cell device of claim 13, with one externally accessible conductor terminal of the beta-cell stack being operatively connected to the positive terminus of a series of individual cells with the positive terminal of each other cell being connected to the negative terminal of a successive cell and the final negative terminus of said series being connected to the other externally accessible conductor terminal of the beta-cell stack.

16. The beta-cell device of claim 13, wherein the beta radiation source is selected from compounds containing $^{90}Sr$, $^{147}Pm$, $^{170}Tm$, $^{3}H$, $^{63}Ni$, $^{137}Cs$, $^{141}Ce$, and $^{204}Tl$.

17. The beta-cell device of claim 13, wherein said semiconductor junction strata comprise Schottky-barrier junctions, each junction comprising a metal contact deposited on the icosahedral boride compound.

18. The beta-cell device of claim 13, wherein said semiconductor junction strata comprise p-n junctions, each p-n junction comprising juxtaposed layers of an n-type region and a p-type region.

* * * * *